US005771642A

United States Patent [19]

Lester

[11] Patent Number: 5,771,642

[45] Date of Patent: Jun. 30, 1998

[54] EARTHQUAKE SURVIVABLE PLATFORM FOR ELEVATED STRUCTURES

[76] Inventor: William M. Lester, 616 S. Orange Ave., Apt. SH2, Maplewood, N.J. 07040

[21] Appl. No.: 549,455

[22] Filed: Oct. 27, 1995

[51] Int. Cl.[6] ..... E02D 27/34

[52] U.S. Cl. ..... 52/167.1; 52/167.4; 52/167.5

[58] Field of Search ..... 52/167.1, 167.4, 52/167.5, 167.9, 127.2, 736.2, 73, 653.1; 404/1

[56] References Cited

U.S. PATENT DOCUMENTS

| | | | |
|---|---|---|---|
| 2,943,716 | 7/1960 | Babcock | 52/653.1 |
| 3,114,302 | 12/1963 | Finsterwalder | 404/1 |
| 3,460,446 | 8/1969 | Finsterwalder et al. | 404/1 |
| 3,638,377 | 2/1972 | Caspe | 52/167.4 |
| 3,732,655 | 5/1973 | Termohlen et al. | 52/167.4 X |
| 4,363,149 | 12/1982 | Kondo et al. . | |
| 4,587,779 | 5/1986 | Staudacher | 52/167.2 |
| 4,644,714 | 2/1987 | Zayas | 52/167.4 |
| 4,793,105 | 12/1988 | Caspe | 52/167.2 |
| 5,035,394 | 7/1991 | Haak | 52/167.2 X |
| 5,349,712 | 9/1994 | Kawashima et al. . | |
| 5,375,382 | 12/1994 | Weidlinger . | |

FOREIGN PATENT DOCUMENTS

| | | | |
|---|---|---|---|
| 4231832 | 2/1994 | Germany | 404/1 |
| 1169022 | 7/1989 | Japan | 52/167.8 |
| 0633990 | 11/1978 | U.S.S.R. | 52/167.4 |
| 1689522 | 11/1991 | U.S.S.R. | 52/167.6 |

*Primary Examiner*—Creighton Smith
*Attorney, Agent, or Firm*—Jean-Marc Zimmerman

[57] ABSTRACT

An free standing platform for enabling elevated structures to survive earthquakes in which the columns supporting the elevated structure rest and float on platforms positioned between the columns and the ground, said platforms able to withstand and dissipate the forces present during an earthquake, and said columns being able to slidably move atop said platforms, thereby enabling the columns to survive the earthquake intact and to continue supporting the elevated structure.

17 Claims, 3 Drawing Sheets

EARTHQUAKE SURVIVABLE PLATFORM FOR ELEVATED STRUCTURES

FIELD OF THE INVENTION

This invention relates generally to devices which enable structures to survive earthquakes and more particularly to a device which can enable an elevated structure to survive an earthquake.

BACKGROUND OF THE INVENTION

An earthquake is any abrupt disturbance within the crust of the earth which is tectonic or volcanic in origin and which results in the generation of elastic waves along geologic faults. *Brittanica Micropaedia Ready Reference,* Vol. 4, at page 322 (15th ed. 1993). The tectonic plate theory postulates that the earth is made up of a number of large, rigid plates which move relative to one another and interact at their boundaries. Earthquakes occur when one plate boundary frictionally slides past and descends beneath the convergent boundary of another plate. This sudden fracturing of rock causes seismic waves to be generated which often results in violent shaking at the earth's surface. See *Brittanica,* supra, Vol. 4, at page 323.

Earthquakes occur all around the world, sometimes causing severe damage to property and life. Several well-known, recent earthquakes include the 1985 earthquake in Mexico City, Mex., in which approximately 10,000 people were killed, and the 1989 earthquake in northern California in the United States, which caused extensive property damage, including damage to elevated highways in the San Francisco area. See *Brittanica,* supra.

Due to their geological character, certain locations, such as that portion of the State of California which sits astride the San Andreas fault, are more prone to earthquakes than others. Consequently, in order to minimize property damage, certain communities in these earthquake prone locations, such as San Francisco, Calif., have instituted building codes which require that newly constructed structures be "earthquake resistant", and thus able to withstand specified forces which the structure is expected to experience during an earthquake. Along with these building codes have come inventions to enable structures, and in particular elevated structures such as bridges and elevated highways, to survive an earthquake. These devices are well known in the art. See U.S. Pat. Nos. 5,349,712, 5,375,382 and 4,363,149.

Conventional devices for enabling elevated structures to survive earthquakes suffer from several drawbacks. They tend to be complicated, involving, for example, elaborate systems of braces or piston-controlled damping systems. In addition, many of these devices fail to serve their intended purpose because even when they are utilized, the columns which support the elevated structure remain in direct contact with the ground and are thus susceptible to being seriously damaged during an earthquake. Consequently, if an earthquake is sufficiently strong such that a column is unable to withstand the forces unleashed by the quake, then the column, whether it rests on the ground or is imbedded into the ground below the surface of the earth, will be destroyed and the elevated structure will collapse to the ground.

It is, therefore, an object of this invention to provide a device which will overcome the foregoing drawbacks of conventional earthquake survivable devices by providing a platform which is positioned between the column or columns and the ground, such that during an earthquake, the platform can withstand and thus absorb and dissipate the forces created by the quake, thereby limiting the damage to the column or columns and preventing the elevated structure from collapsing.

SUMMARY OF THE INVENTION

An earthquake survivable platform for elevated structures in which the columns supporting the elevated structure rest atop platforms positioned between the columns and the ground, said platforms able to withstand and thus absorb and dissipate the forces unleashed by an earthquake, and said columns able to slidably move atop said platforms, thereby enabling the columns to survive the earthquake with little or no damage and to continue supporting the elevated structure.

DETAILED DESCRIPTION OF THE DRAWINGS

Figure 1:
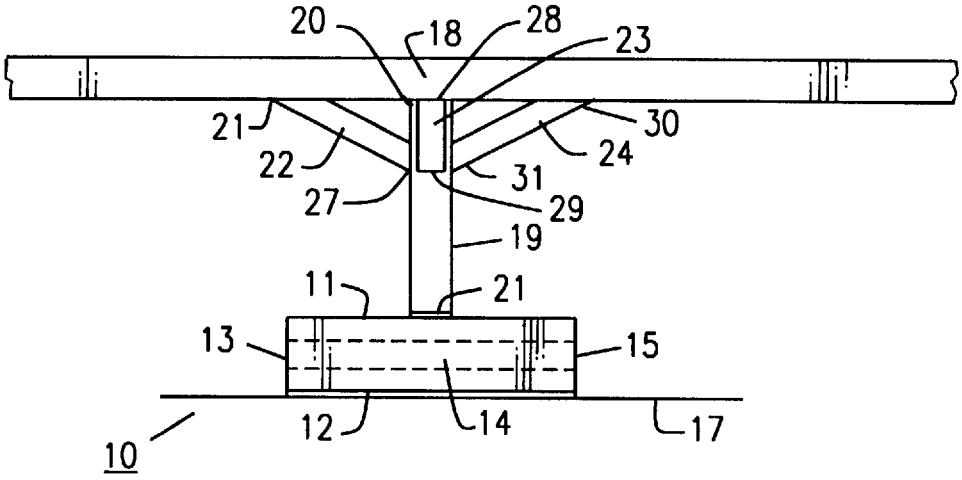
FIG. 1 shows a side view of a first embodiment of the earthquake survivable platform for elevated structures according to this invention in which one column rests on the platform.

FIG. 1 shows an earthquake survivable platform for elevated structures 10 (hereinafter "platform") according to the present invention. Platform 10 is a rectangularly-shaped, free-standing island. Platform 10 is reinforced throughout with lateral beams running along the length of said platform. Platform 10 can be fabricated from any material strong enough to support heavy loads and able to withstand the forces generated during an earthquake. Platform 10 need not be rectangularly-shaped. Owing to its large size, platform 10 can not be prefabricated, but must instead be built on-site. The length of platform 10 is always positioned, whenever possible, perpendicularly to a given fault line. Platform 10 has a top surface 11, a bottom surface 12, a first side surface 13, a second side surface 14, a third side surface 15, and a fourth side surface 16. Bottom surface 12 of platform 10 is set in ground 17. Alternatively, bottom surface 12 can rest on ground 17.

Elevated structure 18 shown in FIG. 1 is an elevated highway. A section of said elevated structure 18 is supported by column 19. Column 19 has a first end 20 and a second end 21. First end 20 is rigidly fastened to elevated structure 18, while second end 21 rests atop platform 10. Column 19 is also rigidly fastened to elevated structure 18 by means of braces 22, 23, 24 and 25. Brace 22 has a first end 26 and a second end 27, brace 23 has a first end 28 and a second end 29, brace 24 has a first end 30 and a second end 31, and brace 25 has a first end 32 and a second end 33.

First end 26 of brace 22, first end 28 of brace 23, first end 30 of brace 24, and first end 32 of brace 25 are all rigidly fastened to elevated structure 18. Second end 27 of brace 22, second end 29 of brace 23, second end 31 of brace 24, and second end 33 of brace 25 are all rigidly fastened to column 19. A lubricant can be placed between second end 21 of column 19 and top surface 11 of platform 10 to enable column 19 to more easily move atop platform 10. All of the columns used to support elevated structure 18 are rigidly fastened to said elevated structure in the same manner as column 19, and each such column rests atop a platform identical to platform 10.

Figure 2:
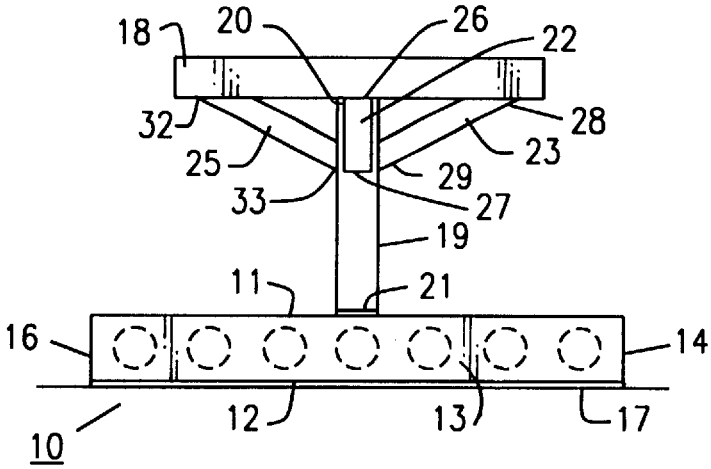
FIG. 2 shows a front view of the platform and the column shown in FIG. 1.
Figure 3:
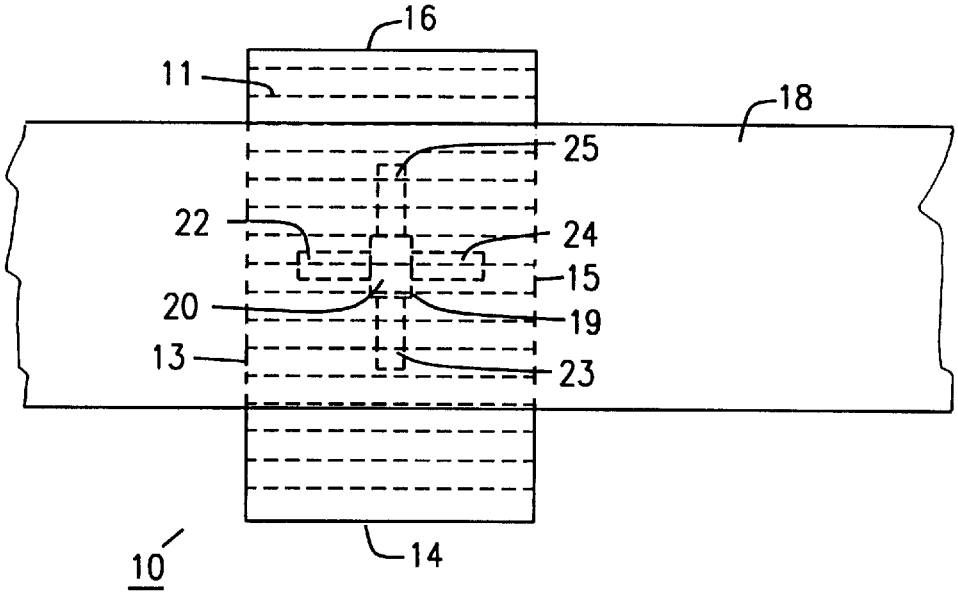
FIG. 3 shows a top plan view of the platform and column shown in FIG. 1.

During an earthquake, platform 10 will absorb and dissipate the forces generated during an earthquake, thereby insulating column 19 from said forces and enabling column 19 to remain intact and able to continue supporting elevated structure 18. In this manner, column 19, and that section of elevated structure 18 supported by column 19, can move up and down and/or slidably move atop platform 10 and thus withstand the destructive forces generated during an earthquake. The advantage of this device over conventional devices is that platform 10 acts as a buffer between column 19 and ground 17, so that column 19 is no longer directly in contact with ground 17, and is therefore no longer directly exposed to the destructive forces present during an earthquake. FIG. 2 shows a front view of platform 10 and column 19 shown in FIG. 1. FIG. 3 shows a top plan view of platform 10 and column 19 shown in FIG. 1.

Figure 4:
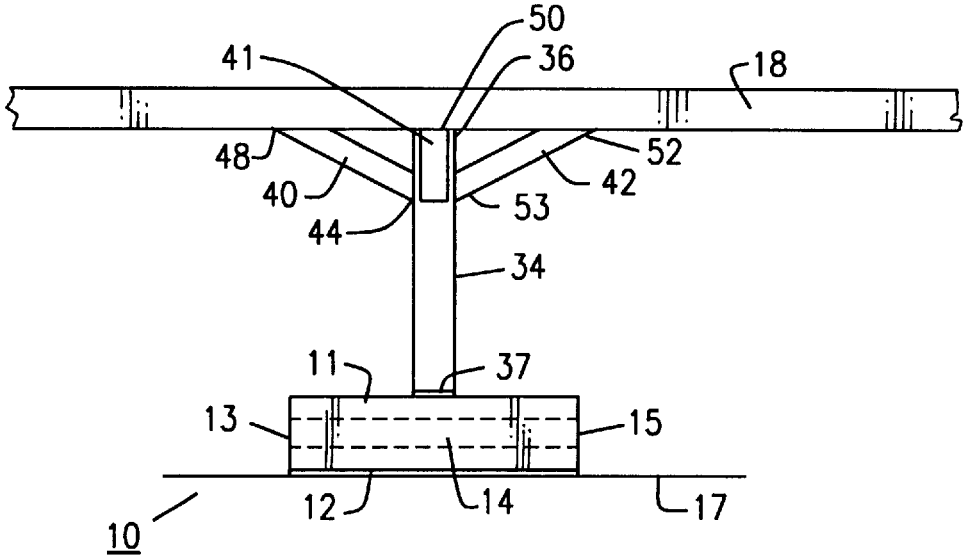
FIG. 4 shows a side view of a second embodiment of the earthquake survivable platform for elevated structures according to this invention in which two columns rest on the platform.

FIG. 4 shows a second embodiment of the present invention wherein column 34 and column 35, which each support a different section of elevated structure 18, both rest atop platform 10. Column 34 has a first end 36 and a second end 37, and column 35 has a first end 38 and a second end 39. First ends 36 and 38 are rigidly fastened to elevated structure 18 at two different spots, while second ends 37 and 39 rest and float atop top surface 11 at two different spots. Column 34 is also rigidly fastened to elevated structure 18 by means of braces 40, 41, 42, and 43, and column 35 is rigidly fastened to elevated structure 18 by means of braces 44, 45, 46 and 47.

Brace 40 has a first end 48 and a second end 49, brace 41 has a first end 50 and a second end 51, brace 42 has a first end 52 and a second end 53, and brace 43 has a first end 54 and a second end 55. Similarly, brace 44 has a first end 56 and a second end 57, brace 45 has a first end 58 and a second end 59, brace 46 has a first end 60 and a second end 61, and brace 47 has a first end 62 and a second end 63. First end 48 of brace 40, first end 50 of brace 41, first end 52 of brace 42, and first end 54 of brace 43 are all rigidly fastened to elevated structure 18. Similarly, First end 56 of brace 44, first end 58 of brace 45, first end 60 of brace 46, and first end 62 of brace 47 are all rigidly fastened to elevated structure 18. Second end 49 of brace 40, second end 51 of brace 41, second end 53 of brace 42, and second end 55 of brace 43 are all rigidly fastened to column 19. Similarly, second end 57 of brace 44, second end 59 of brace 45, second end 61 of brace 46, and second end 63 of brace 47 are all rigidly fastened to column 19. All of the columns used to support elevated structure 18 are rigidly fastened to elevated structure 18 in the same manner as columns 34 and 35, and each such column rests atop a platform identical to platform 10.

Figure 5:
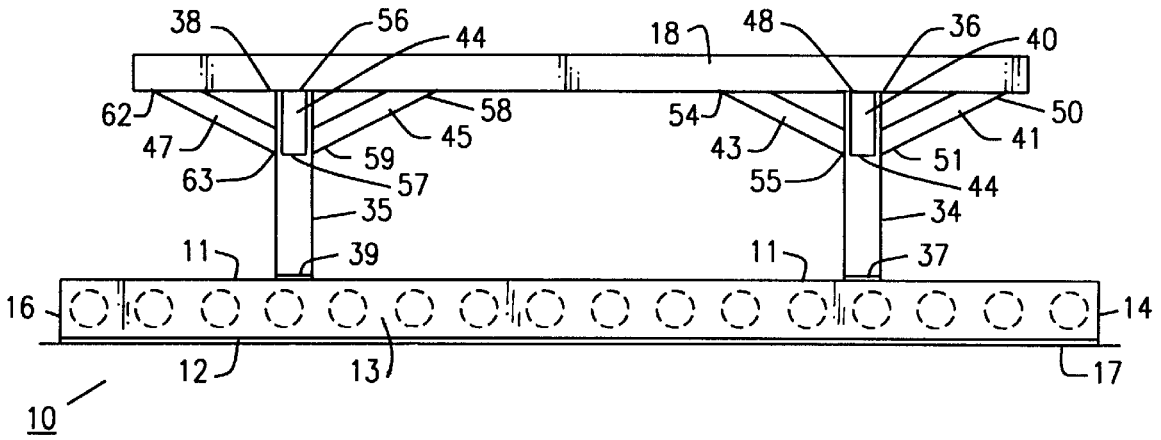
FIG. 5 shows a front view of the platform and two columns shown in FIG. 4.
Figure 6:
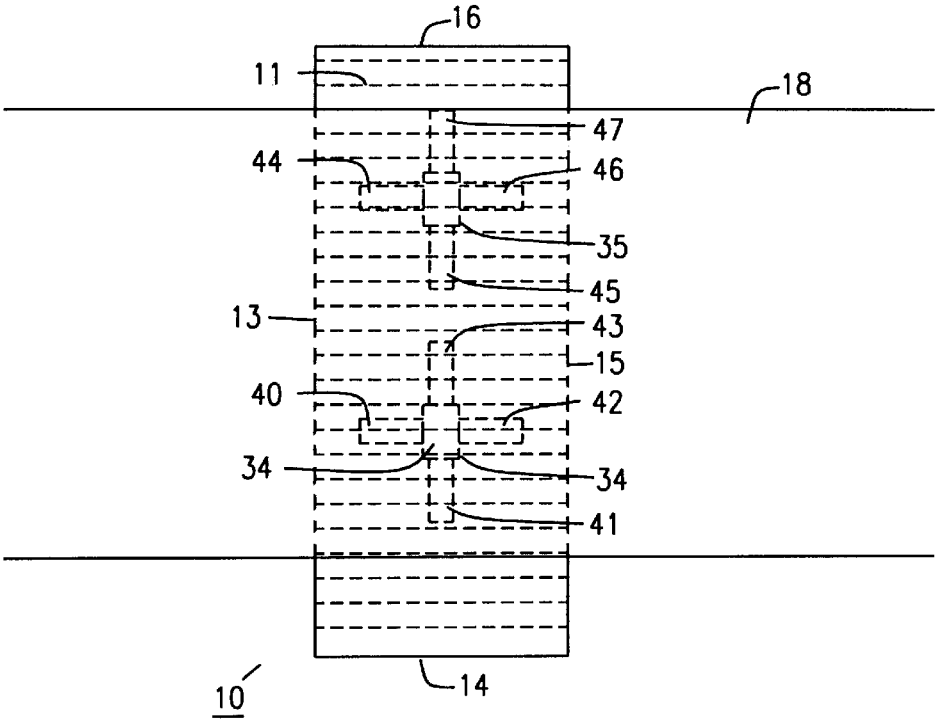
FIG. 6 shows a top plan view of the platform and two columns shown in FIG. 4.

During an earthquake, platform 10 will absorb and dissipate the forces generated by the earthquake, thereby insulating columns 34 and 35 from said forces and enabling columns 34 and 35 to remain intact and able to continue supporting elevated structure 18. In this manner, columns 34 and 35, and those sections of elevated structure 18 supported by columns 34 and 35, can move up and down and/or slidably move atop platform 10 and thus withstand the destructive forces generated during an earthquake. FIG. 5 shows a front plan view of platform 10 and columns 34 and 35 shown in FIG. 3. FIG. 6 shows a top plan view of platform 10 and columns 34 and 35 shown in FIG. 3.

It will be understood that the embodiments described herein are merely exemplary and that a person skilled in the art may make many variations and modifications to the described embodiment utilizing functionally equivalent elements to those described. Any variations or modifications to the invention just described are intended to be included within the scope of said invention as defined by the appended claims.

What is claimed is:

1. A device in combination with an elevated highway for surviving an earthquake, said device comprising:

a bearingless free-standing platform structure having a flat, horizontal top surface and a bottom surface, wherein said bottom surface is embedded in the ground; and a bearingless column which supports said elevated highway said column having a first end and a second end, wherein said first end of said column is fastened to said elevated highway and said second end rests atop said top surface of said platform structure, said second end slidably moving atop said top surface, whereby said platform structure absorbs and dissipates forces present during an earthquake, thereby preventing said column from being damaged by said earthquake and enabling said column to continue supporting said elevated highway.

2. The device according to claim 1, wherein said girder is coupled to and further supports said elevated highway by means of braces, each one of said braces having a first end and a second end, wherein said first end of each one of said braces is coupled to said elevated structure and said second end of each one of said second braces is coupled to said girder.

3. The device according to claim 1, wherein a lubricant is placed between said second end of said column and said top surface of said platform structure to enable said second end to more easily move atop said top surface.

4. The device according to claim 1, wherein said platform structure is reinforced throughout with lateral beams running along the length of said platform structure.

5. The device according to claim 1, wherein said platform structure is rectangular in shape.

6. The device according to claim 1, wherein said platform structure is non-rectangular in shape.

7. A device in combination with an elevated highway for surviving an earthquake, said device comprising:

a bearingless free-standing platform structure having a flat, horizontal top surface and a bottom surface, wherein said bottom surface is embedded in the ground; and a bearingless column which supports said elevated highway said column having a first end and a second end, wherein said first end of said column is fastened to said elevated structure and said second end of said column rests atop said top surface of said platform structure, said column being coupled to and further supporting said elevated highway by means of braces, each one of said braces having a first end and a second end, wherein said first end of each one of said braces is fastened to said elevated highway and said second end of each one of said braces is fastened to said column, said second end of said column slidably moving atop said top surface, whereby said platform structure absorbs and dissipates forces present during an earthquake, thereby preventing said column from being damaged by said earthquake and enabling said column to continue supporting said elevated highway.

8. The device according to claim 7, wherein a lubricant is placed between said second end of said column and said top surface of said platform structure to enable said second end to more easily move atop said top surface.

9. The device according to claim 7, wherein said platform structure is reinforced throughout with lateral beams running along the length of said platform.

10. The device according to claim 7, wherein said platform structure is rectangular in shape.

11. The device according to claim 7, wherein said platform structure is non-rectangular in shape.

12. A device in combination with an elevated highway for surviving an earthquake, said device comprising:

a bearingless free-standing platform structure having a flat, horizontal top surface and a bottom surface, wherein said bottom surface is embedded in the ground; and a bearingless first column which supports a first section of said elevated highway, said first column having a first end and a second end, wherein said first end of said first column is fastened to said first section of said elevated highway and said second end of said first column rests atop a first section of said top surface of said platform structure; and a bearingless second column which supports a second section of said elevated highway, said second column having a first end and a second end, wherein said first end of said second column is fastened to said second section of said elevated highway and said second end of said second column rests atop a second section of said top surface of said platform structure, said first column and said second column slidably moving atop said top surface, whereby said platform structure absorbs and dissipates forces present during an earthquake, thereby preventing said first column and said second column from being damaged by said earthquake and enabling said first column and said second column to continue supporting said elevated highway.

13. The device according to claim 12, wherein said first and said second girders are coupled to and further support said elevated highway by means of braces, each one of said braces having a first end and a second end, wherein said first end of each one of said braces is coupled to said elevated structure and said second end of each one of said second braces is coupled to said first girder or said second girder.

14. The device according to claim 12, wherein a lubricant is placed between said second ends of said first and said second columns and said top surface of said platform structure to enable said second ends of said first and said second columns to more easily move atop said top surface.

15. The device according to claim 12, wherein said platform structure is reinforced throughout with lateral beams running along the length of said platform structure.

16. The device according to claim 12, wherein said platform structure is rectangular in shape.

17. The device according to claim 12, wherein said platform structure is non-rectangular in shape.

* * * * *